US007934690B1

(12) United States Patent
Walter

(10) Patent No.: US 7,934,690 B1
(45) Date of Patent: May 3, 2011

(54) FLAG HOLDER

(75) Inventor: Daniel F. Walter, Frankenmuth, MI (US)

(73) Assignee: Frankenmuth Post 150 American Legion Department of Michigan, Frankenmuth, MI (US)

( * ) Notice: Subject to any disclaimer, the term of this patent is extended or adjusted under 35 U.S.C. 154(b) by 359 days.

(21) Appl. No.: 12/263,502

(22) Filed: Nov. 2, 2008

Related U.S. Application Data

(60) Provisional application No. 60/985,005, filed on Nov. 2, 2007.

(51) Int. Cl.
*A01K 97/10* (2006.01)

(52) U.S. Cl. ..... 248/539; 40/124.5

(58) Field of Classification Search ..... 248/539, 248/534, 231.9; 40/124.5, 600; 116/173, 116/175, 28 R; 52/103, 168; D11/181, 182; D99/18, 23
See application file for complete search history.

(56) References Cited

U.S. PATENT DOCUMENTS

| | | | | |
|---|---|---|---|---|
| D018,517 | S | 8/1888 | Arnold | |
| 427,815 | A | 5/1890 | Wolf | |
| D051,647 | S | 1/1918 | Lawton | |
| D062,288 | S | 5/1923 | Jones | |
| 1,500,870 | A | 7/1924 | Holdredge | |
| D075,474 | S | 6/1928 | Camelo | |
| 1,966,922 | A | 7/1934 | Coleman | |
| 2,148,660 | A * | 2/1939 | Sweeney | 40/124.5 |
| D231,628 | S | 5/1974 | Bartels | |
| 3,977,110 | A | 8/1976 | Yerger | |
| 4,334,661 | A | 6/1982 | Pitt | |
| 5,454,178 | A * | 10/1995 | Rivard | 40/124.5 |
| 5,517,790 | A | 5/1996 | Jennings | |
| D404,687 | S | 1/1999 | Restrepo | |
| D476,131 | S | 6/2003 | Barnes | |
| D503,842 | S | 4/2005 | Barnes | |
| D506,703 | S | 6/2005 | Venick | |
| D516,951 | S | 3/2006 | Venick | |
| D531,544 | S | 11/2006 | Restrepo | |

* cited by examiner

*Primary Examiner* — Gwendolyn Baxter
(74) *Attorney, Agent, or Firm* — Robert L. Farris; Farris Law, P.C.

(57) ABSTRACT

The flag holder includes a plate surrounded by an edge flange. Raised letters and symbols are integral with a plate face side. Letters, symbols and edge flange have flat surfaces in a front plane. The plate has a rear side and three mounting bosses with rear surfaces and threaded bores. Surfaces of the edge flange and the bosses are in a rear plane parallel to the front plane and the plate front side. Two vertically spaced tongue members extend from an outside surface of the edge flange. A U-shaped flag pole recess in each tongue has an open end that faces rearward. Three threaded pins are received in the threaded bores. Epoxy holds the pins in gravestone bores. Flag pole recesses are closed by the gravestone. A pole support surface is on the edge flange.

12 Claims, 7 Drawing Sheets

FLAG HOLDER

CROSS REFERENCE TO RELATED APPLICATIONS

This application claims the benefit of the filing date of U.S. Provisional Application No. 60/985,005 titled FLAG HOLDER filed Nov. 2, 2007

TECHNICAL FIELD

The flag holder attaches to a military veteran's gravestone and holds a small American flag on a small flag pole generally formed by a wood dowel.

BACKGROUND OF THE INVENTION

American Legion Posts, in many parts of the United States, place American flags on the graves of veterans. These flags are often placed in cemeteries before Memorial Day in May. In some locations they remain until after Veteran's Day on November $11^{th}$. It is also common to place flags on graves shortly before Veteran's Day in cemeteries when flags are removed after Memorial Day.

The current flag holders include a metal body portion, and a metal stake. The body portion includes a vertical bore that receives a flag pole and a threaded bore. The threaded bore receives a threaded upper end of the stake. The stake is forced into the ground near a gravestone. These flag holders present a number of problems in cemeteries. Some cemeteries will not permit their employment. Grass cutting machines frequently hit the body portion, damage the body portion and bend the stake. Occasionally the flag holder is destroyed. Other times the flag holder can be repaired. Wind blows the flag against the gravestone, damages the flag, and shortens the flag's useful life. Vibrations caused by the wind blowing the flags over a period of years can destroy the threaded bore in the metal body. The stake portion may corrode or oxidize. Removal of the flag holders may be required to facilitate cemetery maintenance. Occasionally a flag holder is moved to the grave of a non-veteran. Some flag holders are also removed from cemeteries without approval to do so.

SUMMARY OF THE INVENTION

The flag holder includes a plate portion with a face side, a rear side. A plate portion edge is surrounded by an edge flange that extends to the front of the front side and that extends to the rear of the rear side. A series of raised letters and at least one symbol are integral with the face side of the plate portion and extend away from the face side. A front flat surface on the edge flange is in a vertical front plane that is parallel to the plate portion and spaced from the face side of the plate portion. A letter flat surface on each of the series of raised letters is in the vertical front plane. A symbol flat surface is also in the vertical front plane.

A rear flat surface on the edge flange is in a rear plane that is parallel to the vertical front plane and spaced to the rear of the rear side of the plate portion. At least three mounting bosses are integral with the plate portion. These mounting bosses extend to the rear of the rear side of the plate portion to a mounting boss rear surface, on each of the at least three mounting bosses, that is in the rear plane. A threaded bore in each of the at least three mounting bosses is in the rear plane. The threaded bore in each of the at least three mounting bosses is surrounded by the mounting boss rear surface and normal to the rear plane.

An upper tongue is integral with the edge flange and extends away from the edge flange and the plate portion. An upper U-shaped flag pole passage passes vertically through the upper tongue. An upper tongue rear edge surface extends to each side of an open top of the upper U-shaped flag pole passage. The upper tongue rear edge surface is in the rear plane.

A lower tongue is integral with the edge flange and extends away from the edge flange and the plate portion. A lower U-shaped flag pole passage passes vertically through the lower tongue. A lower tongue rear edge surface extends to each side of an open top of the lower U-shaped flag pole passage that is in the rear plane. The lower U-shaped flag pole passage is in vertical alignment with and spaced from the upper U-shaped flag pole passage.

Each, of at least three threaded mounting pins, is screwed into one of the threaded bores and extends rearward from the rear plane. A flag pole support surface on the edge flange is in vertical alignment with the upper U-shaped flag pole passage and the lower U-shaped flag pole passage and below the lower tongue.

Each of the threaded mounting pins has a shoulder that engages a mounting boss rear surface of the mounting boss and thread bore that receives the threaded mounting pin.

The flag holder includes a powder coat coating that provides corrosion protection.

The plate portion of the flag holder includes a horizontal bar member that extends laterally outward to outward to a least two outboard edges of the plate portion. The edge flange also surrounds the horizontal bar member. The flag pole support surface is on the edge flange directly above the horizontal bar member of the plate portion.

The flag holder is powder coated with a powder coat that includes a pigment. The powder coat is removed from surfaces in the front plane to expose bright metal. The flag holder is then powder coated with a transparent coat to retain the brightness of the bright metal.

The at least three threaded mounting pins are received in bores in a gravestone and retained by an epoxy adhesive. The open top of the upper U-shaped flag pole passage and the open top of the lower U-shaped flag pole passage are both closed by a gravestone flat surface.

A stainless steel plate is clamped to the surfaces in the rear plane by a shoulder on the threaded mounting pins when the flag holder is mounted on a rough or non-vertical surface.

BRIEF DESCRIPTION OF THE DRAWINGS

The presently preferred embodiments of the invention are disclosed in the following description and in the accompanying drawings, wherein.

DETAILED DESCRIPTION OF THE PREFERRED EMBODIMENT

Figure 1:
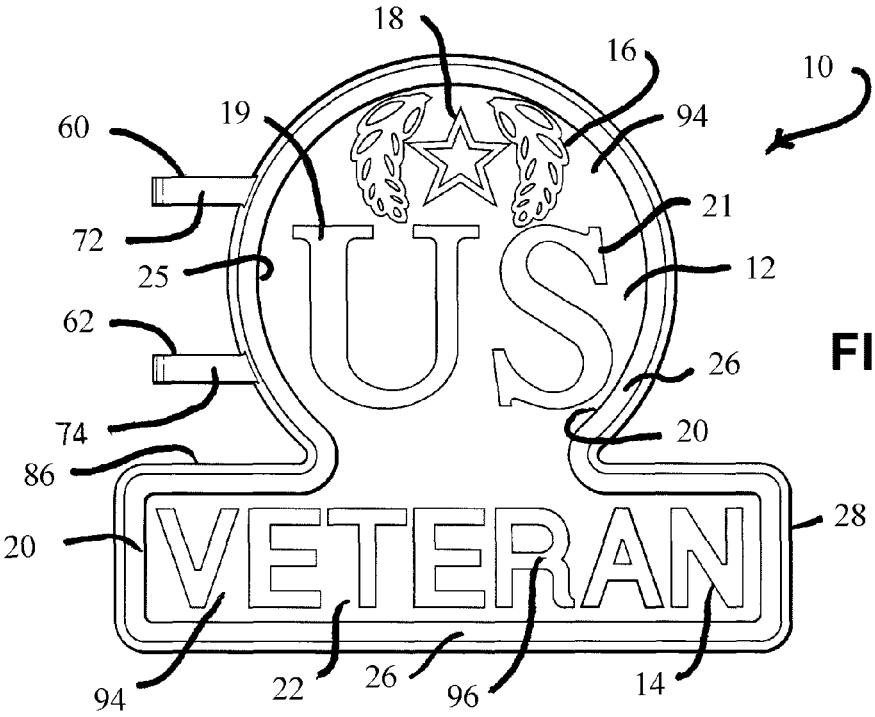
FIG. 1 is a front elevational view of the flag holder.
Figure 2:
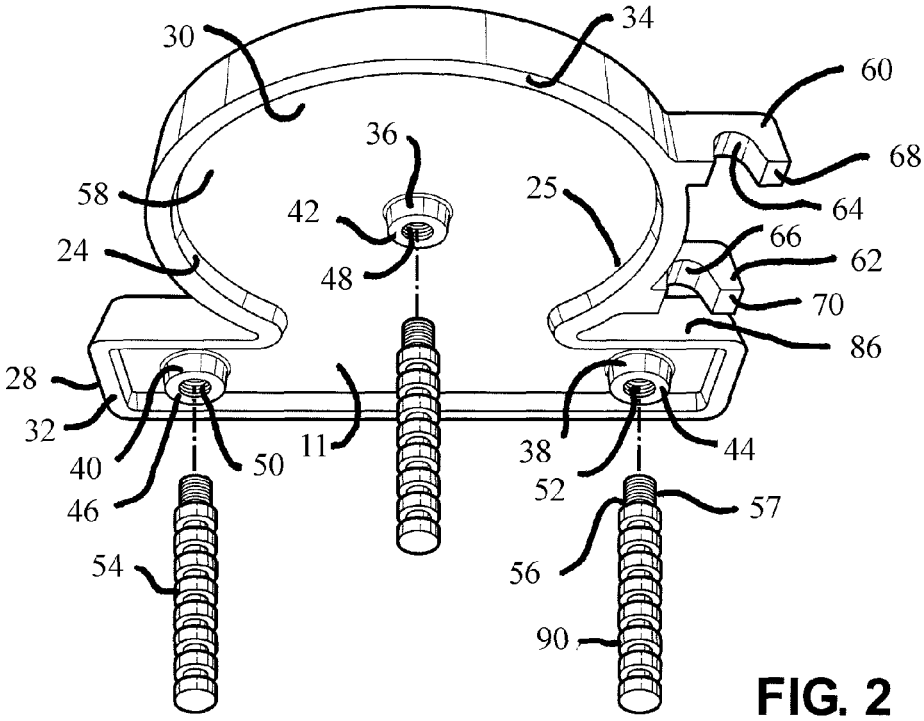
FIG. 2 is an expanded rear perspective view of the flag holder.
Figure 3:
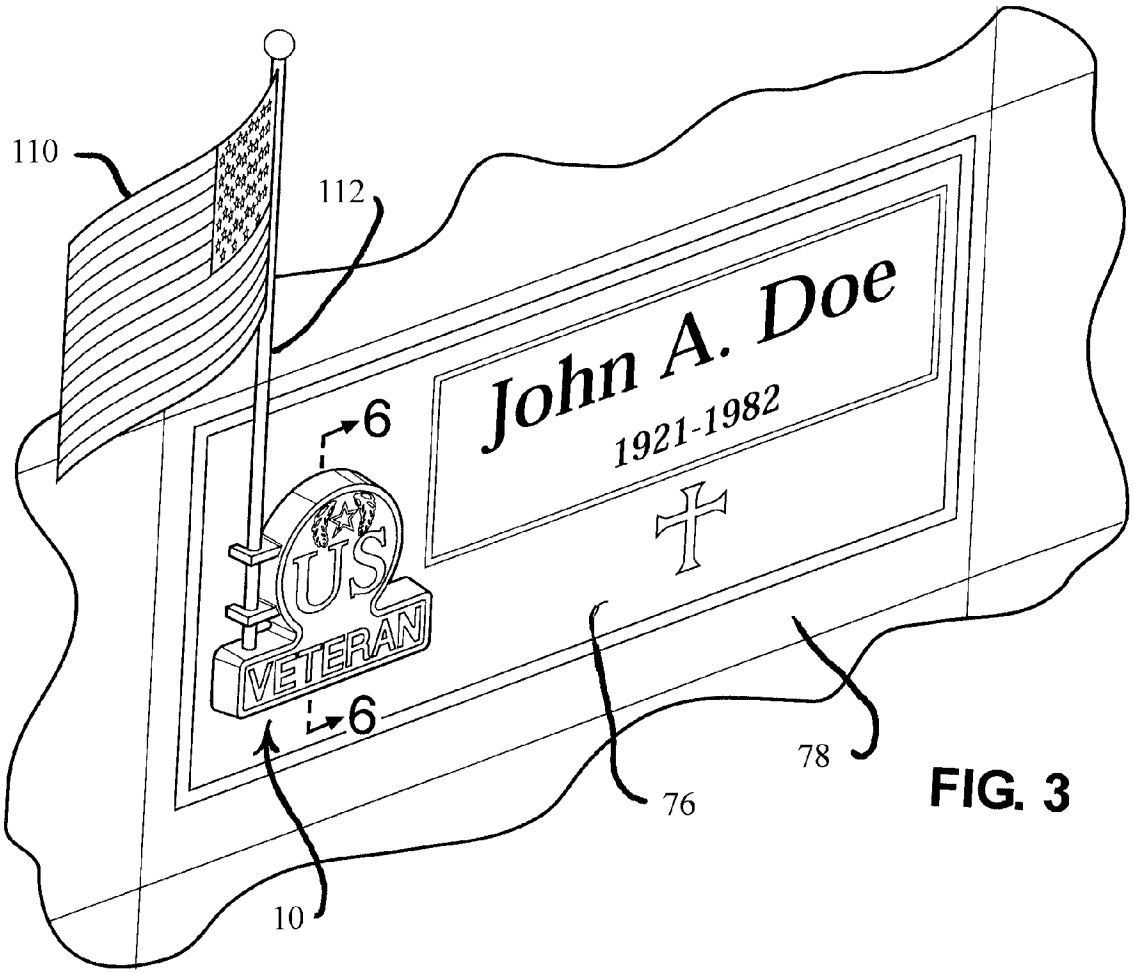
FIG. 3 is a perspective view showing the flag holder attached to the front face of a gravestone and holding a flag.
Figure 4:
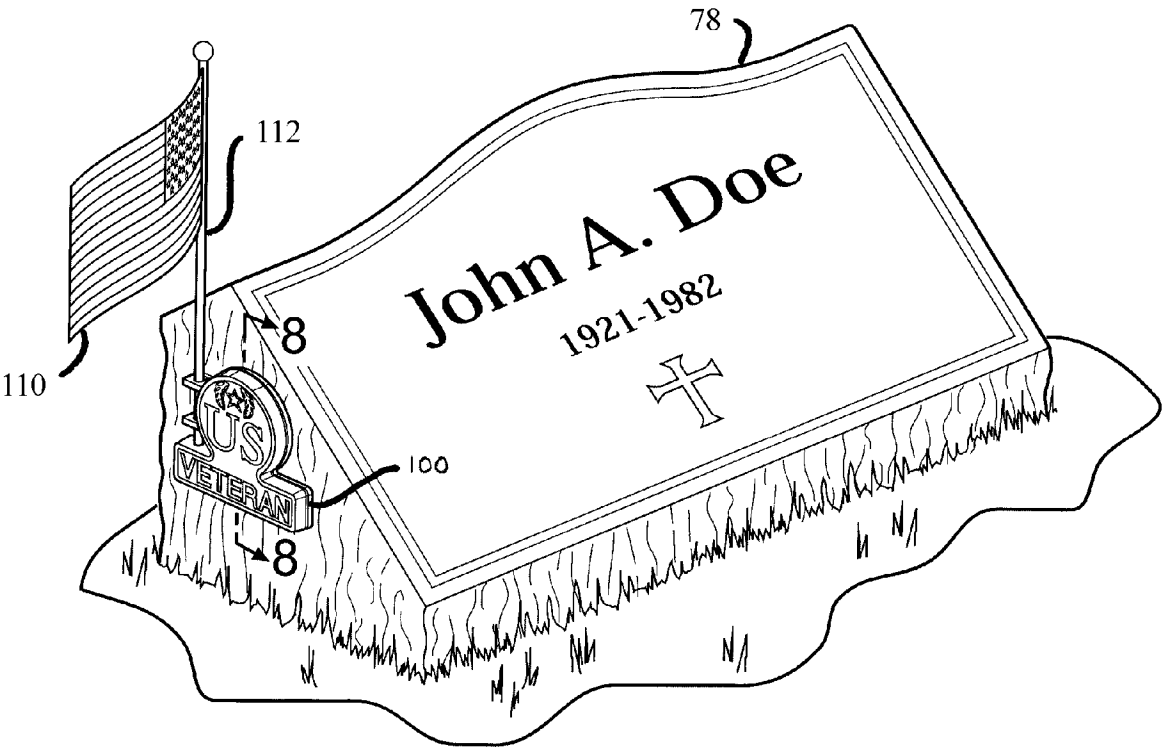
FIG. 4 is a perspective view showing the flag holder attached to a rough uneven side surface of a gravestone and holding a flag.
Figure 5:
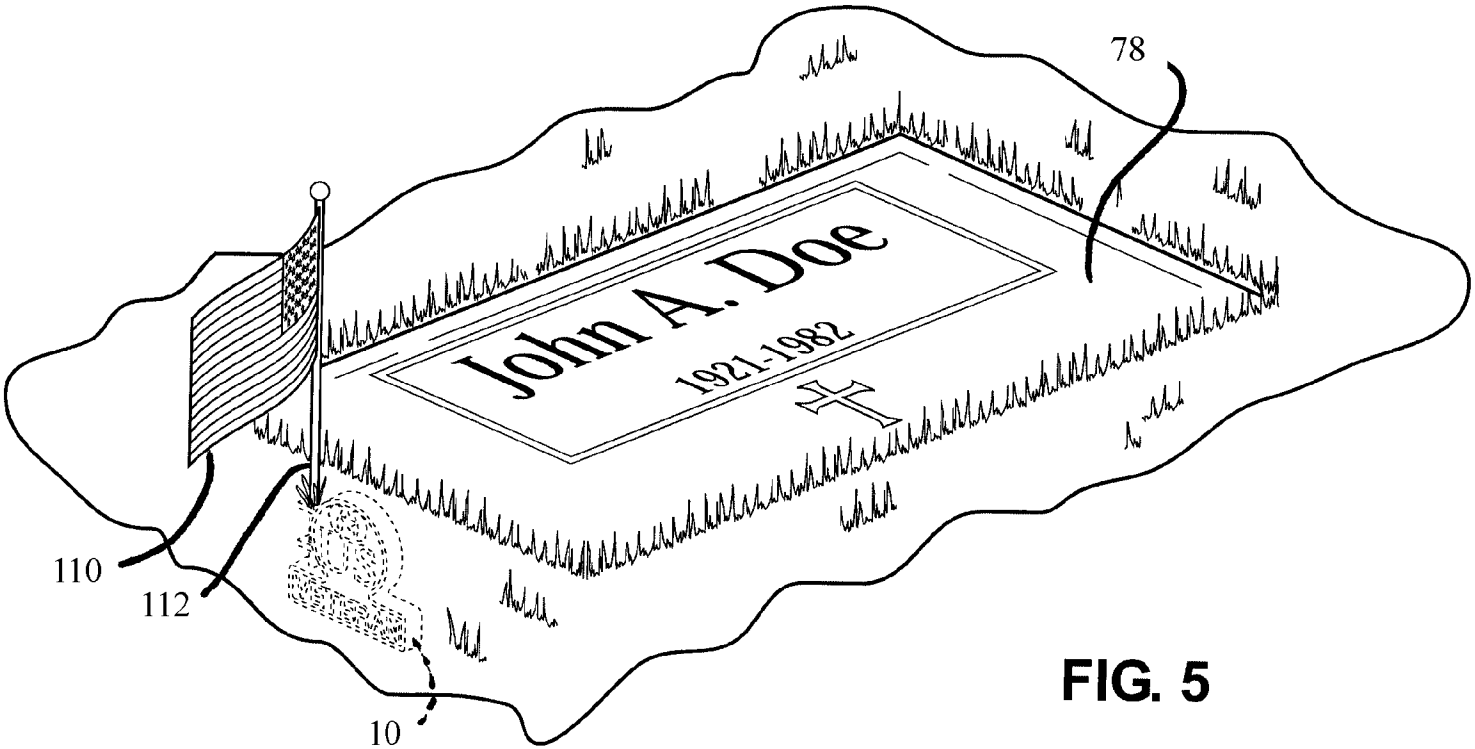
FIG. 5 is a perspective view showing the flag holder attached to an underground vertical surface of a gravestone with a horizontal top surface at ground level and holding a flag.

The flag holder 10 is a cast bronze armorial ensign and emblem. The flag holder 10 includes a plate portion 11 with face side 12 of the flag holder having raised letters 14 and symbols 16 and 18. The symbols and letters are surrounded by an edge flange 20. The edge flange 20, the symbols 16 and 18 and the letters 14 have face surfaces that are in a front vertical plane 26. A recessed surface 22 is inside the edge flange 20, behind the letters and behind the symbols 16 and 18. The symbols 16 are olive branches. Olive branches 16 are symbols of peace. The star symbol 18 is a badge of honor. The large letters "U" 19 and "S" 21 are abbreviations for the United States of America. The raised letters 14 on the horizontal bar 28 at the bottom of the flag holder are the word "VETERAN" and indicate that the deceased person served in the armed forces of the United States. The flag holder 10 could be made from other metals. The flag holder 10 can also be made from non metallic materials.

The backside 58 of the flag holder includes a recessed surface 30 surrounded by an edge flange 24. The edge flanges 20 and 24 are two portions of one flange. The flange 20 and 24 is integral with the edge 25 of the plate portion 11. The gravestone engaging surface 32 is in a rear vertical plane 34. The front vertical plane 26 and the rear vertical plane 34 are parallel to each other and spaced apart.

Three mounting bosses 36, 38 and 40 extend rearward from the recessed surface 30. The rear surfaces 42, 44 and 46 of the mounting bosses 36, 38 and 40 are in the rear vertical plane 34. Each of the mounting bosses 36, 38 and 40 has a threaded bore 48, 50 and 52. The threaded bores 48, 50 and 52 do not extend through the flag holder 10. Threaded mounting pins 54 screw into the threaded bores 48, 50 and 52. Each mounting pin 54 has a shoulder 56 that engages the rear surfaces 42, 44 or 46 of the mounting boss 36, 38 or 40 to which it is attached. A threaded portion 57 of each mounting pin 54 is received in one of the threaded bores 48, 50 or 52. The portions of each of the mounting pins 54 that extend out of the bosses 36, 38 and 40 have ridges 90 and valleys 92. These ridges and valleys can be threads or other retaining shapes.

Two vertically spaced apart tongues 60 and 62 extend horizontally outward from left side of the edge flanges 20 and 24. A generally U-shaped flag pole passage 64 is provided in the tongue 60. A generally U-shaped flag pole passage 66 is provided in the tongue 62. The ends of the passages 64 and 66 facing rearward away from the face side 12 are open. The two passages 64 and 66 are in vertical alignment with each other. The passages 64 and 66 are also in vertical alignment with a flagpole support 86 on the edge flange 24 of the horizontal bar 28. The sides of the U-shaped flag pole passages 64 and 66 have a draft for casting that results in an increase distance between the passage side walls at the open end. The rear edge surfaces 68 and 70 of the tongues 60 and 62, adjacent to open ends of the U-shaped flag pole passages 64 and 66, are in the rear vertical plane 34. The front edge surface 72 and 74 of the tongues 60 and 62 are spaced away from the front vertical plane 26 and toward the rear vertical plane 34.

The flag holder 10 is mounted on a generally flat vertical surface 76 of a gravestone 78. Three bores 80, 82 and 84 drilled into the gravestone 78. A template is employed to insure that the three bores 80, 82 and 84 are properly spaced and oriented. An epoxy resin 88 or other suitable adhesive is inserted into each of the bores 80, 82 and 84.

Threaded mounting pins 54 are screwed into each of the threaded bores 48, 50 and 52 and tightened. The three threaded mounting pins 54 are inserted into the respective bores 80, 82 and 84 with the epoxy. The flag holder 10 is then clamped against a flat vertical surface 76 of the gravestone 78 with flag holder gravestone engaging surfaces 32 in the rear vertical plane 34 in engagement with the gravestone 78. The flag holder 10 is held in place while the epoxy cures. After the epoxy cures, the clamp is removed. The flag pole is inserted through the U-shaped flag pole passages 64 and 66 and into engagement with the flag pole support 86 on the edge flange 24. The vertical surface 76 of the gravestone 78 closes the open ends of the U-shaped flag pole passages 64 and 66. The tongues 60 and 62 cooperate with the gravestone 78 to hold a flag pole generally vertical and in engagement with the flag pole support 86.

The flag holder 10 is cast from molten bronze or another copper alloy poured into a mold. If desired other metals or non metallic materials can be used. After cleaning, the casting may be coated with a powder including a pigment and then heated to form a powder coat that will prevent corrosion. The powder coat forms a protective coating 94. The mounting bosses 36, 38 and 40 are drilled and tapped to form threaded bores 48, 50 and 52. The face side 12 of the flag holder is machined to expose the metal faces surfaces of the edge flange 20, the raised letters 14, the large letters 19 and 21, the symbols 16 and the symbol 18. These machined surfaces are all in the front vertical plane 26. The gravestone engaging surfaces 32, the rear surfaces 42, 44 and 46 on the mounting bosses 36, 38 and 40, and the rear surfaces 68 and 70 of the upper tongue 60 and the lower tongue 62 are also machined. These surfaces 32, 42, 44 and 46 are in the rear vertical plane 34. The surfaces in rear vertical plane 34 the flag holder 10 contact the flat vertical surface 76 of the gravestone 78. A clear powder coat is applied to the machined surfaces and the non-machined surfaces of the flag holder 10 to provide a clear corrosion protection coating 96. The machined surfaces retain the color of the bronze, copper alloy, or other metal. Powder coating 96 is employed because it is long lasting.

Figure 6:
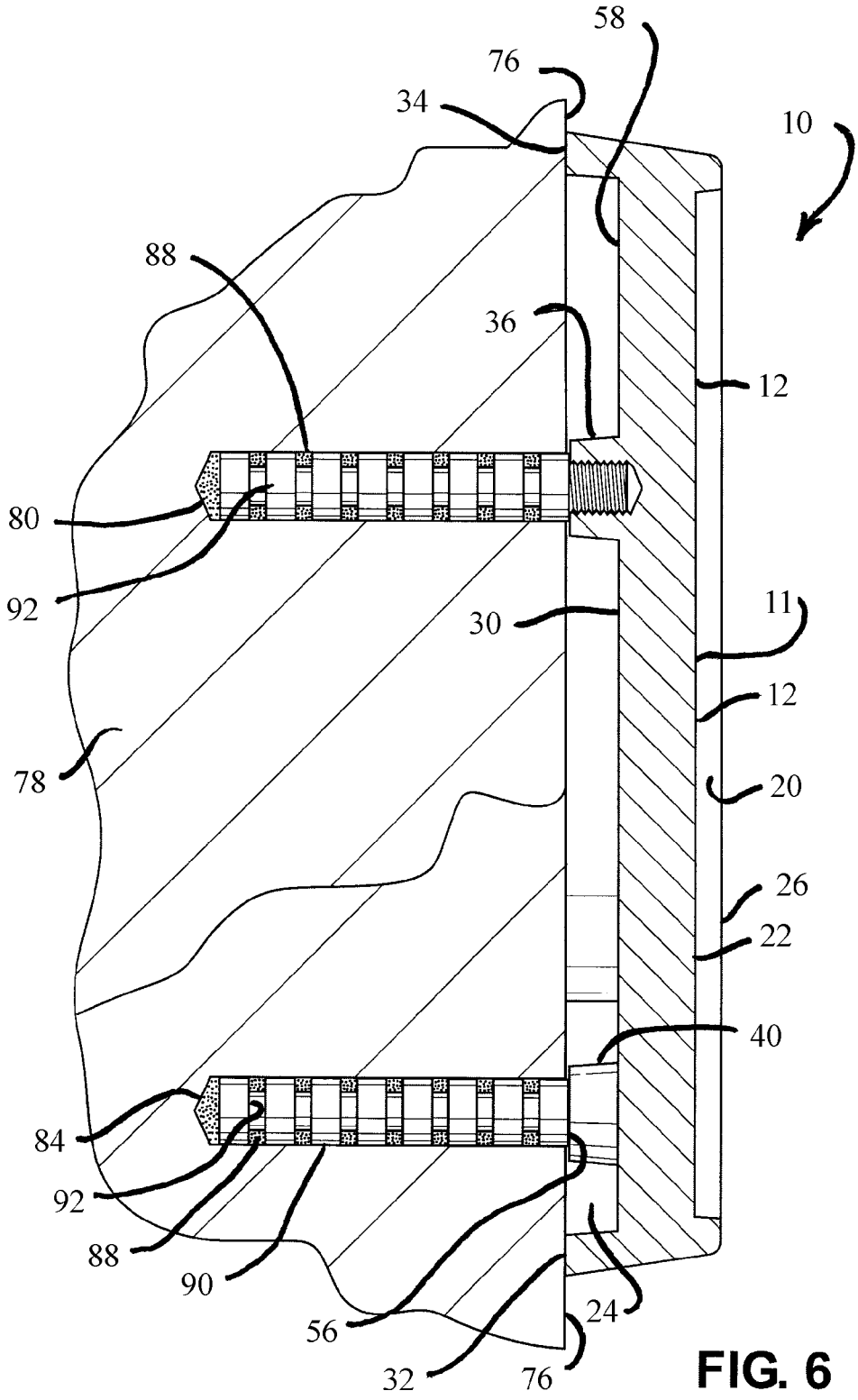
FIG. 6 is an enlarged sectional view of the flag holder taken along line 6-6 in FIG. 3.

The flag holder 10 as described above is mounted on a generally flat vertical surface 76 of a gravestone 78 shown in FIG. 6. The flat vertical surface 76 cooperates with the rear edge surfaces 68 and 70 of the tongues 60 and 62 to retain a flag pole in the generally U-shaped flag pole passages 64 and 66. Some gravestones 78 do not have a flat vertical surface with sufficient size and without gravestone epitaph or other inscription for mounting the flag holder 10. This problem is overcome by clamping a flat plate 100 with three apertures between the rear surfaces 42, 44, and 46 of the mounting bosses 36, 38 and 40 and the shoulder 56 of the threaded mounting pins 54. The flat plate 100 also engages all the surfaces in the rear vertical plane 34 and covers the recessed surface 30. The flat plate also 100 engages the rear edge surfaces 68 and 70 of the tongues 60 and 62 and retains a flag pole in the generally U-shaped flag pole passages 64 and 66. Bores 80, 82 and 84 are parallel to each other and horizontal and intersect a surface of a gravestone 78 that is not flat or that is not vertical. The threaded mounting pins 54 are secured in the bores 80, 82 and 84 as described above with the front vertical plane 26 of the flag holder 10 vertical. This may result in a gap between the flat plate 100 and the gravestone 78. The gap exposes at least a portion of the mounting pins 54. The mounting pins 54 may therefore be made from a material that resists corrosion. Stainless steel could, for example, be employed to make the flat plate and the mounting pins 54.

The pins 54 of a flag holder 10 are completely encased, when the flag holder is mounted on a flat vertical surface 76 of a gravestone 78, and protected from corrosion.

Figure 7:
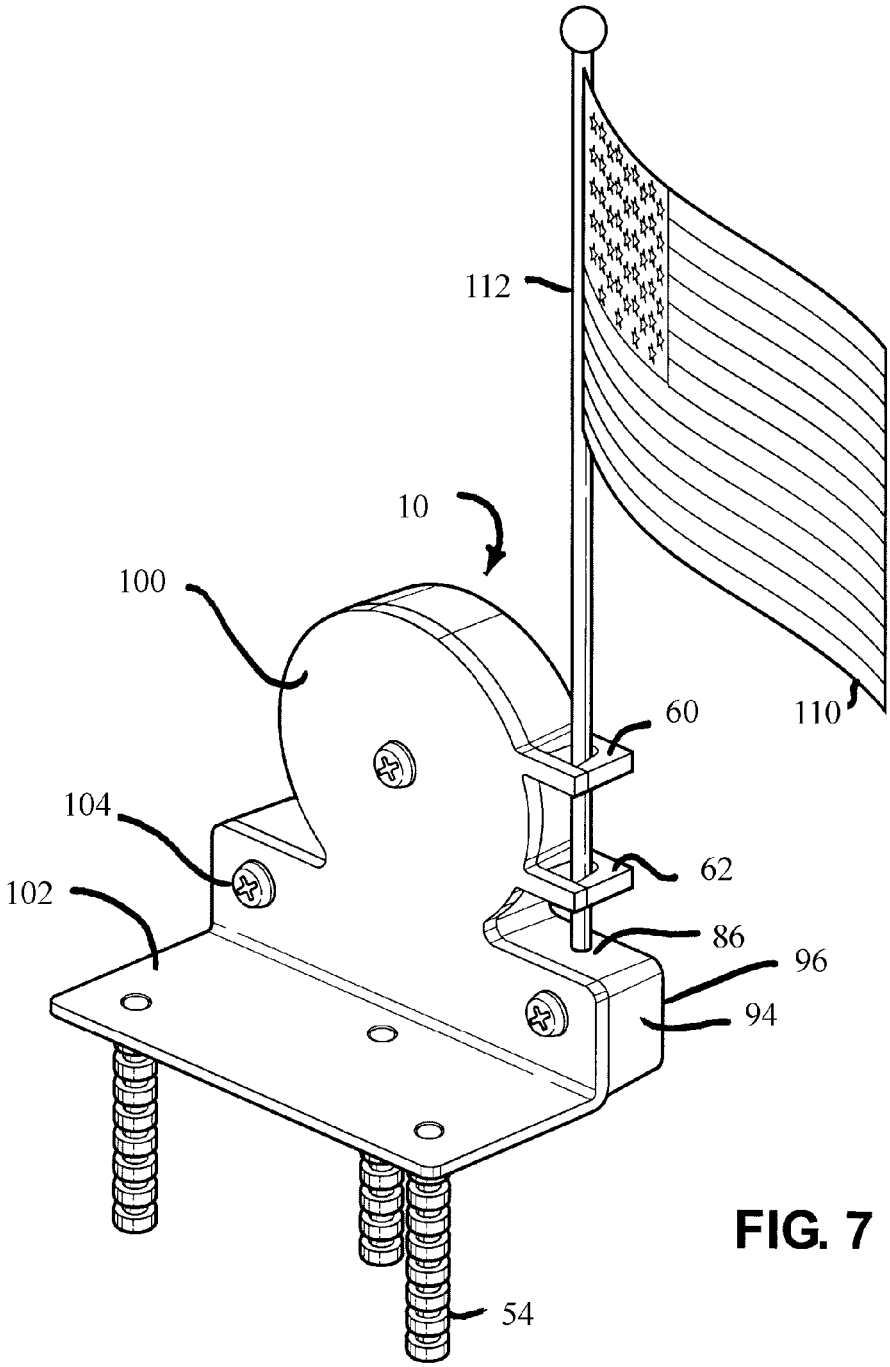
FIG. 7 is a rear perspective view of the flag holder and holder mount for mounting on a horizontal surface.
Figure 8:
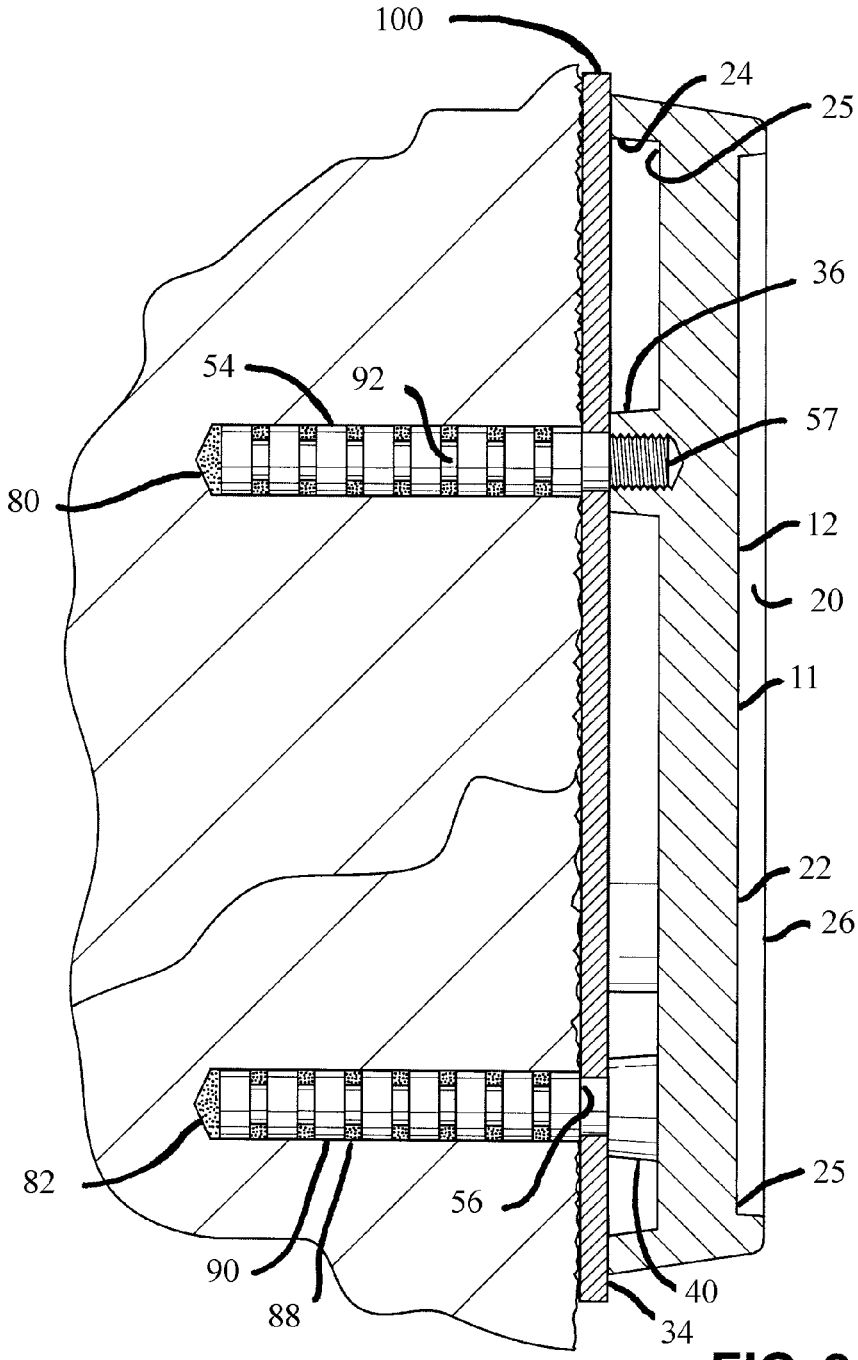
FIG. 8 is a sectional view similar to FIG. 6 with the flag holder mounted on an uneven surface.

The flat plate 100 may be modified, to mount the flag holder 10 on a horizontal surface of a gravestone 78. The modified flat plate 100, as shown in FIG. 7, includes an integral flange 102. This flange 102 extends to the rear of the flag holder 10. As shown the integral flange 102 is perpendicular to the vertical flat plate portion 100. The vertical flat plate 100, as shown in FIG. 7, is clamped to the flag holder 10 by three threaded fasteners 104. The vertical plate 100 engages and covers all of the surfaces of the flag holder that are in the rear vertical plane 34 including the rear edge surface 68 and 70 of the tongues 60 and 62. The threaded fasteners 104 can be provided with fastener heads that permit them to be tightened but not removed. Three parallel threaded mounting pins 54 screw into the flange 102 as shown in FIG. 7. The three mounting pins 54 are secured in three bores 80, 82 and 84 as described above.

The flange 102 as described above is for attaching a flat plate 100 and an attached flag holder 10 to a horizontal surface on a gravestone 78. The integral bottom flange 102 can extend from the flat plate 100 at an angle other than ninety degrees for attachment to non-horizontal surfaces on gravestones. The integral flange 102 could also be integral with a portion of the flat plate 100 other than the bottom edge for attachment to gravestones 78 that can not accommodate direct attachment of the flag holder.

The flags 110 held by the flag holder 10 are usually eight inches high by twelve inches long or twelve inches high by eighteen inches long. The flag pole 112 used is usually a round wood dowel with a five sixteenths of an inch diameter. The flags 110 can be somewhat smaller or somewhat larger. The production flag holder can receive a flag pole with a diameter of three eights of an inch. The flag holder 10 can however be reduced or enlarged in size.

The flag holder 10 is preferably cast from molten bronze. The flag holder 10 casting is cleaned. The cleaned casting is powder coated, to prevent corrosion, employing powder coating material with a pigment. Various colors of pigment can be used. The surfaces in the front vertical plane 26 are machined to remove the powder coat and expose shiny metal. The surfaces in the rear vertical plane 34 are machined to insure that the surfaces in the rear vertical plane are flat and will engage the flat vertical surface 76 of a gravestone 78 or of a flat plate 100. The flag holder 10 is then powder coated a second time to encase the flag holder in a substantially transparent clear coat to protect the machined surfaces in the front vertical plane 26 and the machined surfaces in the rear vertical plane 34 from corrosion and oxidation. Threaded mounting pins 54 are screwed into each of the threaded bores 48, 50 and 52. An epoxy adhesive is inserted into bores 80, 82 and 84 in a gravestone 78. The threaded mounting pins 54 are then inserted into the bores 80, 82 and 84. The machined surface in the rear vertical plane are held in engagement with the flat vertical surface 76 of the gravestone 78 while the epoxy adhesive cures. The flat vertical surface 76 closes the U-shaped flag pole passages 64 and 66 to retain a flag pole 112. In installations in which a stainless steel flat plate 100 is required, the flat plat closes the U-shaped flag pole passages 64 and 66.

The disclosed embodiments are representative of presently preferred forms of the invention, but are intended to be illustrative rather than definitive thereof. The invention is defined in the claims.

I claim:

1. A flag holder comprising:

a plate portion with a face side, a rear side and a plate portion edge surrounded by an edge flange;

a series of raised letters and at least one symbol integral with the face side of the plate portion and extending away from the face side;

a front flat surface on the edge flange in a front plane that is parallel to the face plate portion and spaced from the face side of the plate portion, a letter flat surface on each of the series of raised letters that is in the front plane and a symbol flat surface that is in the front plane;

a rear flat surface on the edge flange in a rear plane;

at least three mounting bosses integral with the plate portion, extending to the rear of the rear side of the plate portion to a mounting boss rear surface on each of the at least three mounting bosses that is in the rear plane, and a threaded bore in each of the at least three mounting bosses that is surrounded by the mounting boss rear surface and normal to the rear plane;

an upper tongue integral with the edge flange, extending away from the edge flange and the plate portion and an upper U-shaped flag pole passage passing vertically through the upper tongue and an upper tongue rear edge surface extending to each side of an open top of the upper U-shaped flag pole passage that is in the rear plane;

a lower tongue integral with the edge flange, extending away from the edge flange and the plate portion and a lower U-shaped flag pole passage passing vertically through the lower tongue and a lower tongue rear edge surface extending to each side of an open top of the lower U-shaped flag pole passage passing vertically through the lower tongue and a lower tongue rear edge surface extending to each side of an open top of the lower U-shaped flag pole passage that is in the rear plane and wherein the lower U-shaped flag pole passage is in vertical alignment with and spaced from the upper U-shaped flag pole passage;

at least three threaded mounting pins each of which is screwed into one of the threaded bores and extends rearward from the rear plane;

a flag pole support surface on the edge flange that is in vertical alignment with the upper U-shaped flag pole passage and the lower U-shaped flag pole passage and below the lower tongue; and wherein the rear plane is parallel to the front plane.

2. A flag holder, as set forth in claim 1, wherein the front plane is vertical.

3. A flag holder as set forth in claim 1, including a powder coat that inhibits corrosion of the flag holder.

4. A flag holder, as set forth in claim 1, including a shoulder on each of the at least three mounting pins that engages the mounting boss rear surfaces the threaded bores in which each of the mounting pins is received.

5. A flag holder, as set forth in claim 1, wherein the plate portion includes an horizontal bar member that extends laterally outward to at least two outboard edges of the plate portion.

6. A flag holder, as set forth in claim 5, wherein the flag pole support surface on the edge flange is directly above the horizontal bar member of the plate portion.

7. A flag holder comprising:

a plate portion with a face side, a rear side and a plate portion edge surrounded by an edge flange that extends to the front of the front side and that extends to the rear of the rear side;

a series of raised letters and at least one symbol integral with the face side of the plate portion and extending away from the face side;

a front flat surface on the edge flange in a vertical front plane that is parallel to the plate portion and spaced from the face side of the plate portion, a letter flat surface on each of the series of raised letters that is in the vertical front plane and a symbol flat surface that is in the vertical front plane;

a rear flat surface on the edge flange in a rear plane that is parallel to the vertical front plane and spaced to the rear of the rear side of the plate portion;

at least three mounting bosses integral with the plate portion, extending to the rear of the rear side of the plate portion to a mounting boss rear surface on each of the at least three mounting bosses that is in the rear plane, and a threaded bore in each of the at least three mounting bosses that is in the rear plane, and wherein the threaded bore in each of the at least three mounting bosses is surrounded by the mounting boss rear surface and normal to the rear plan;

an upper tongue integral with the edge flange, extending away from the edge flange and the plate portion and an upper U-shaped flag pole passage passing vertically through the upper tongue and an upper tongue rear edge surface extending to each side of an open top of the upper U-shaped flag pole passage that is in the rear plane;

a lower tongue integral with the edge flange, extending away from the edge flange and the plate portion and a lower U-shaped flag pole passage passing vertically through the lower tongue and a lower tongue rear edge surface extending to each side of an open top of the lower U-shaped flag pole passage that is in the rear plane and wherein the lower U-shaped flag pole passage is in vertical alignment with and spaced from the upper U-shaped flag pole passage;

at least three threaded mounting pins each of which is screwed into one of the threaded bores and extends rearward from the rear plane;

a flag pole support surface on the edge flange that is in vertical alignment with the upper U-shaped flag pole passage and the lower U-shaped flag pole passage and below the lower tongue.

8. A flag holder, as set forth in claim 6, including a shoulder, on each of the at least three threaded mounting pins, that engages a mounting boss rear surface of the mounting bosses and the threaded bores which receive each of the threaded mounting pins.

9. A flag holder, as set forth in claim 7, including a power coat protective coating that provides corrosion protection.

10. A flag holder, as set forth in claim 7, wherein the plate portion includes a horizontal bar member that extends laterally outward to at least two outboard edges of the plate portion and wherein the edge flange also surrounds the horizontal bar member.

11. A flag holder, as set forth in claim 10, wherein the flag pole support surface on the edge flange is directly above the horizontal bar member of the plate portion.

12. A flag holder, as set forth in claim 7, wherein the flag holder is power coated with a powder coat that includes a pigment, the powder coat is removed from the surfaces in the front flat edge flange, the letter flat surface on each of the series of raised letters and the symbol flat surface which are in the vertical front plane; and a transparent power coat on the flag holder.

* * * * *